US006662369B2

(12) United States Patent
Fuchs et al.

(10) Patent No.: US 6,662,369 B2
(45) **Date of Patent: *Dec. 16, 2003**

(54) STAB RESISTANT MATERIAL

(75) Inventors: Yuval Fuchs, Netanya (IL); Christian Böttger, Remscheid (DE); Achim Fels, Wuppertal (DE)

(73) Assignees: Aramid Products GmbH, Wuppertal (DE); FMS Enterprises Ltd., Tel Aviv (IL)

( * ) Notice: Subject to any disclaimer, the term of this patent is extended or adjusted under 35 U.S.C. 154(b) by 77 days.

This patent is subject to a terminal disclaimer.

(21) Appl. No.: 09/775,671

(22) Filed: Feb. 5, 2001

(65) Prior Publication Data

US 2001/0031593 A1 Oct. 18, 2001

Related U.S. Application Data

(63) Continuation of application No. PCT/EP99/05574, filed on Jul. 30, 1999.

(30) Foreign Application Priority Data

Aug. 4, 1998 (EP) ..... 98114608

(51) Int. Cl.[7] ..... F41H 1/02; B32B 5/26

(52) U.S. Cl. ..... 2/2.5; 442/239; 442/255; 442/261; 442/286; 428/911

(58) Field of Search ..... 2/2.5; 428/911; 442/239, 255, 261, 286

(56) References Cited

U.S. PATENT DOCUMENTS

| | | | | | |
|---|---|---|---|---|---|
| 4,287,607 | A | * | 9/1981 | Leach | 2/2.5 |
| 4,738,893 | A | | 4/1988 | Grillo | 428/252 |
| 5,001,003 | A | | 3/1991 | Mahr | 428/247 |
| 5,677,029 | A | * | 10/1997 | Prevorsek et al. | 428/113 |

FOREIGN PATENT DOCUMENTS

| | | | | |
|---|---|---|---|---|
| WO | WO 97/21334 | | 6/1997 | J41H/5/00 |
| WO | 97/21334 | * | 6/1997 | J41H/5/00 |

* cited by examiner

*Primary Examiner*—Ula Ruddock
(74) *Attorney, Agent, or Firm*—Oliff & Berridge, PLC

(57) ABSTRACT

The present invention is a stab-resistant material made from at least two woven fabrics joined using a polymer film. The woven fabrics are made from yarns having a tensile strength of at least 900 MPa. The polymer film joining the woven fabrics has a tensile strength of at least 10 MPa and a flexural modulus of 1500 to 4500 MPa.

14 Claims, No Drawings

STAB RESISTANT MATERIAL

This is a Continuation of International Application No. PCT/EP99/05574 filed Jul. 30, 1999. The entire disclosure of the prior application is hereby incorporated by reference herein in its entirety.

BACKGROUND OF THE INVENTION

1. Field of Invention

The invention relates to a stab-resistant material made from at least two woven fabrics joined by using a polymer film, a stab-resistant package, and use of the stab-resistant package in making protective clothing.

2. Description of Related Art

A stab-resistant material is known from WO 97/21334, wherein the polymer film used in the material has a flexural modulus of 42 to 1000 MPa. From the examples of WO 97/21334, it is clear that 38 to 45 layers of the stab-resistant material are required to provide stab protection that the specification considers to be sufficient.

The evaluation of the stab-resistant quality in WO 97/21334 is performed in accordance with CEN/TC 162/WG 5 N 479. According to this standard, two different knives are to be used, and the penetration of each knife up to 20 mm is regarded as sufficient stab protection. WO 97/21334 teaches the use of 38 to 45 layers of its stab-resistant material to be sufficiently stab-resistant. The use of 38 to 45 layers of the stab resistant material in WO 97/21334 results in reduced wearing comfort since the large number of layers makes the clothing both very heavy and stiff to the wearer.

As described above, there is still a need for stab-resistant material that offers improved wearing comfort and improved effectiveness.

SUMMARY OF THE INVENTION

It is an aspect of the present invention to provide a stab-resistant material that provides sufficient stab protection.

It is a further aspect of the present invention to provide a stab-resistant material to be used in the manufacture of protective clothing that is less heavy and stiff, and offers improved wearing comfort.

These and other aspects of the present invention are achieved herein.

According to the present invention, a stab-resistant material made from at least two woven fabrics which are joined using a polymer film, wherein the fabrics are made from yarns with a tensile strength of at least 900 MPa and the polymer film joining the fabrics has a tensile strength of at least 10 MPa, exhibits improved effectiveness when the polymer film has a flexural modulus of 1500 to 4500 MPa.

DETAILED DESCRIPTION OF PREFERRED EMBODIMENTS

The present invention provides a stab-resistant material made from at least two woven fabrics which are joined using a polymer film, wherein the fabrics are made from yarns with a tensile strength of at least 900 MPa, and the polymer film joining the fabrics has a tensile strength of at least 10 MPa and a flexural modulus of 1500 to 4500 MPa.

Surprisingly, it has been discovered that, when using such a polymer film, significantly fewer layers of the stab-resistant material of the present invention are required to provide effective stab protection than in the case of prior art stab-resistant materials.

The yarns forming the woven fabrics may have a tensile strength of 1500 to 6000 MPa, most preferably 3000 to 6000 MPa. In the respect, practically all yarns suited for use in ballistic protection, such as yarns made from polyolefin, in particular polyethylene, from polyamide, polyimide, polyester, or poly (p-phenylene-2,6-benzobisoxazole) may be used in the present invention. Yarns made from aramids are especially preferred.

It has proven especially favorable for the stab-resistant material of the invention to comprise two woven fabrics laminated using the polymer film.

In the stab-resistant material of the invention, it is preferred that the polymer film joining the fabrics have a flexural modulus of 1500 to 4500 MPa, most preferably from 2000 to 3000 MPa.

Suitable polymers for the polymer film include, for example, hard PVC, with a flexural modulus of between 3500 and 4000 MPa, or polyurethanes with a flexural modulus of between 4000 and 4500 MPa. Polycarbonates are especially preferred. An especially preferred polycarbonate is marketed under the name LEXAN 103 by GE Plastics. LEXAN 103 has a flexural modulus of 2500 MPa, a tensile strength of 70 MPa, and an elongation at break of 120%.

It is also advantageous if the polymer film has an elongation at break of at least 80%, for example 100% or 120%.

As is also the case in WO 97/21334, the flexural modulus in the present invention is to be determined in accordance with ASTM D-790, the tensile strength of the film in accordance with ASTM D-638, the elongation at break in accordance with ASTM D-638, and the tensile strength of the yarn in accordance with ASTM D-885.

Regarding the fabrics used for the stab-resistant material of the invention, it is preferred that they have a plain weave, especially if they have a fabric density, calculated according to Walz, of 25 to 80%, preferably 25 to 60%.

The fabric density according to Walz is calculated according to the following formula:

$$DG=(d_k+d_s)^2 \cdot f_k \cdot f_s$$

where:

$d_k$=substance diameter of the warp yarn in mm;

$d_s$=substance diameter of the weft yarn in mm;

$f_k$=warp threads per cm; and $f_s$=weft threads per cm.

The substance diameter $d_k$ or $d_s$ of the yarns is calculated as follows:

$$d=(\text{titer})^{1/2}/88.5\ (\text{density})^{1/2}$$

where d is either $d_k$ or $d_s$, the titer of the corresponding yarn is in dtex, and the density of the yarn is in g/cm$^3$.

The values given above apply in particular to fabrics with plain weave. If other than plain weaves apply, a weave correction factor must be included in the calculation. For this weave correction factor, the following values are used for fabrics with specific weaves:

| Weave | Weave correction factor |
|---|---|
| Hopsack weaves 2:2 | 0.56 |
| Twill weaves 2:1 | 0.70 |

-continued

| Weave | Weave correction factor |
|---|---|
| Twill weaves 2:2 | 0.56 |
| Twill weaves 3:1 | 0.56 |
| Twill weaves 4:4 | 0.38 |
| Satin 1:4 | 0.49 |

The fabric density DG calculated according to the Walz formula is multiplied by these correction factors.

The fabric density DG according to Walz is a quantity expressed in %. In the case of highly dense fabrics, values can exceed 100%.

The stab-resistant material of the invention is optimally suited for manufacturing stab-resistant packages that have multiple layers of the stab-resistant material of the invention. It is especially favorable for a stab-resistant package of the invention to have 6 to 30 and preferably 10 to 25 layers of the stab-resistant material. It is also possible to have additional layers made from other materials. For improved handling, it is advantageous that in the stab-protection package of the invention, several or all layers are positioned in an envelope made from a textile material.

The stab-resistant package in accordance with the invention is optimally suited for manufacturing protective clothing.

The invention will be explained in more detail on the basis of the following examples:

EXAMPLE I

Woven fabrics are manufactured in plain weave from aramid yarns with a titer of 840 dtex and a tensile strength of 3600 MPa. The fabric density according to Walz is 46%, and the weight of the fabrics is 215 g/m$^2$. Positioned between two fabrics is a polymer film made from polycarbonate (LEXAN 103), having a specific weight of 135 g/m$^2$. The lamination of the two fabrics with the polymer film is performed in a temperature range of 220 to 230° C. and at a pressure of about 10 bar.

Various numbers of these laminates are placed into an envelope made from polyarnide woven fabric and the penetration depth of knives 1 and 2 (an English (no. 1) and a German knife) is determined in accordance with CEN/TC 162/WG 5 N 479. When the stab-resistant package consists of 8 laminates, there is penetration of only 10 mm with knife 1. When as few as 10 laminates are used in the envelope, no penetration is noted with knife 1, while a penetration of 25 mm is noted with knife 2. After 15 laminates are arranged one on top of the other in the envelope, there is penetration of only about 5 mm with knife 2, while penetration by knife 1 is not noted. With knife 1, it is even observed that the tip of the knife is bent after the test. In the case of 20 laminates in the envelope, penetration is no longer noted with knife 2 either.

EXAMPLE II

In a further test, woven fabrics are produced from aramid yarns with a titer of 840 dtex and a tensile stength of 3600 MPa in plain weave. The fabric density according to Walz is 30% and the fabric weight is 170 g/m$^2$. A polymer film made from polycarbonate (LEXAN 103) with a specific weight of 135 g/m$^2$ is positioned between two fabrics. The lamination of the two fabrics with the polymer film is performed in a temperature range of 220 to 230° C. and a pressure of about 10 bar.

Various numbers of these laminates are placed into an envelope made from polyarnide woven fabric and the penetration depth of knives 1 and 2 (an English (no. 1) and a German knife) is determined in accordance with CEN/TC 162/WG 5 N 479. When the stab-resistant package consisted of 8 laminates, there is a penetration of only 10 mm with knife 1 (average value). When as few as 10 laminates are used in the envelope, penetration is no longer noted for knife 1, however the requirements of the standard are not met for knife 2. After 15 laminates are arranged one on top of the other in the envelope, there is a penetration of only about 10 mm with knife 2, while again penetration is still not noticeable with knife 1.

What is claimed is:

1. Stab-resistant material, comprising at least more than one laminate consisting of two woven fabrics laminated together with a polymer film such that the two woven fabrics are joined via the polymer film, wherein the fabrics comp se yarns having a tensile strength of at least 900 MPa, and the polymer film joining the fabrics has a tensile strength of at least 10 MPa and a flexural modulus of 1500 to 4500 MPa.

2. Stab-resistant material according to claim 1, wherein the yarns have a tensile strength of 900 to 8000 MPa.

3. Stab-resistant material according to claim 1, wherein the polymer film has a flexural modulus of 2000 to 3000 MPa.

4. Stab-resistant material according to claim 1, wherein the fabrics have a plain weave.

5. Stab-resistant material according to claim 1, wherein the fabrics have a fabric density, calculated according to Walz, of 25 to 80%.

6. Stab-resistant material according to claim 1, wherein the polymer film is a polycarbonate.

7. Stab-resistant material according to claim 1, wherein the polymer film has an elongation at break of at least 80%.

8. Stab-resistant material according to claim 1, wherein the yarns are aramids.

9. A stab-resistant package comprising a plurality of the laminates of the stab-resistant material according to claim 1.

10. The stab-resistant package according to claim 9, comprising 6 to 30 laminates of the stab-resistant material.

11. The stab-resistant package according to claim 10, comprising 10 to 25 laminates of the stab-resistant material.

12. The stab-resistant package according to claim 10, wherein at least some or all of the laminates are arranged in an envelope made from a textile material.

13. Protective clothing containing the stab-resistant package of claim 12.

14. Protective clothing containing the stab-resistant package of claim 9.

* * * * *

UNITED STATES PATENT AND TRADEMARK OFFICE

CERTIFICATE OF CORRECTION

PATENT NO. : 6,662,369 B2
DATED : December 16, 2003
INVENTOR(S) : Yuval Fuchs et al.

It is certified that error appears in the above-identified patent and that said Letters Patent is hereby corrected as shown below:

Title page,
Item [*] Notice, delete "This patent is subject to a terminal disclaimer."

Column 3,
Line 42, "polyarnide" should be -- polyamide --.
Line 60, "stength" should be -- strength --.

Column 4,
Line 7, "polyarnide" should be -- polyamide --
Line 26, "comp se" should be -- comprise --.
Lines 51 and 53, "claim 10" should be -- claim 9 --.

Signed and Sealed this

Eleventh Day of May, 2004

JON W. DUDAS
*Acting Director of the United States Patent and Trademark Office*